US006481674B1

(12) United States Patent
Lin

(10) Patent No.: US 6,481,674 B1
(45) Date of Patent: Nov. 19, 2002

(54) SUPPORTING FRAME FOR A GOLF BAG

(75) Inventor: Sen-Te Lin, Changhua Hsien (TW)

(73) Assignee: Nai Hui MFG Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 09/997,009

(22) Filed: Nov. 30, 2001

(51) Int. Cl.[7] ..... A63B 55/00
(52) U.S. Cl. ..... 248/96; 206/315.7
(58) Field of Search ..... 248/96; 206/315.3, 206/315.7

(56) References Cited

U.S. PATENT DOCUMENTS

| | | | | | |
|---|---|---|---|---|---|
| 846,552 | A | * | 3/1907 | Bowning | 248/96 |
| 1,686,774 | A | * | 10/1928 | Sperry | 248/96 |
| 1,752,114 | A | * | 3/1930 | Shaw | 248/96 |
| 1,961,454 | A | * | 6/1934 | Reichhart | 248/96 |
| 4,798,357 | A | * | 1/1989 | Cho | 248/96 |
| 5,474,175 | A | * | 12/1995 | Gattis | 206/315.3 |
| 5,607,128 | A | * | 3/1997 | Suk | 248/96 |
| 5,613,604 | A | * | 3/1997 | Maeng | 206/315.7 |
| 5,799,786 | A | * | 9/1998 | Beck et al. | 206/315.7 |

* cited by examiner

*Primary Examiner*—Ramon O. Ramirez
*Assistant Examiner*—Koft Schulterbrandt
(74) *Attorney, Agent, or Firm*—Troxell Law Office PLLC

(57) ABSTRACT

A supporting frame structure for a golf bag mainly has a head bracket attached to the top end of a golf bag, two supporting legs pivotally secured to the head bracket, a transmission block, a linking rod, two guiding shafts, two springs, two connecting rods, two coupling sleeves. The supporting legs are pivotally coupled to the head bracket by way of the coupling sleeves to which the connecting rods are pivotally connected. The coupling sleeves are also pivotally connected to the transmission block with which the two guiding shafts are limitedly engaged so as to permit the transmission block to be driven to slide up and down as the connecting rods are actuated to pivot by the supporting legs. Accordingly the linking rod secured to the transmission block can be adjusted up and down with the help of the springs. Such a structure permits the supporting frame to be operated with ease, safety and speed.

2 Claims, 4 Drawing Sheets

SUPPORTING FRAME FOR A GOLF BAG

BACKGROUND OF THE INVENTION

The present invention relates to a supporting frame structure for a golf bag. It mainly has a head bracket attached to the top end of a golf bag, two supporting legs pivotally secured to the head bracket, a transmission block, a linking rod, two guiding shafts, two springs, two connecting rods, two coupling sleeves. The supporting legs are in pivotal connection to the head bracket by way of the coupling sleeves to which the connecting rods are in pivotal connection. The coupling sleeves are also pivotally connected to the transmission block with which the two guiding shafts are limitedly engaged so as to permit the transmission block to be driven to slide up and down as the connecting rods are actuated to pivot by the supporting legs. Accordingly the linking rod secured to the transmission block can be adjusted up and down with the help of the springs. Such a structure permits the supporting frame to be operated with ease, safety and speed.

A typical prior art supporting frame has a first and second resilient pieces, a driving board and a pair of supporting legs. The first resilient piece made of steel and hooked to the driving board is easily got stuck as the driving board disposed at the bottom of a golf bag is activated as a result of the rigidity of the first resilient piece being uncertain in mass production. As the extension and collection of the two supporting legs are controlled by the relief and extension of the second resilient piece, a retaining piece can be easily damaged by the excessive force of the spring retracted supporting legs in practical operation.

SUMMARY OF THE INVENTION

The primary object of the present invention is to provide an improved supporting frame for a golf bag. It can be operated with convenience, speed and less effort by simply pushing the golf bag into a tilted position or vertical position in practical use.

Another object of the present invention is to provide an improved supporting frame for a golf bag which is designed to operate in a firm and safe manner without easy damage of its structure.

DETAILED DESCRIPTION OF THE PREFERRED EMBODIMENT

Figure 1:
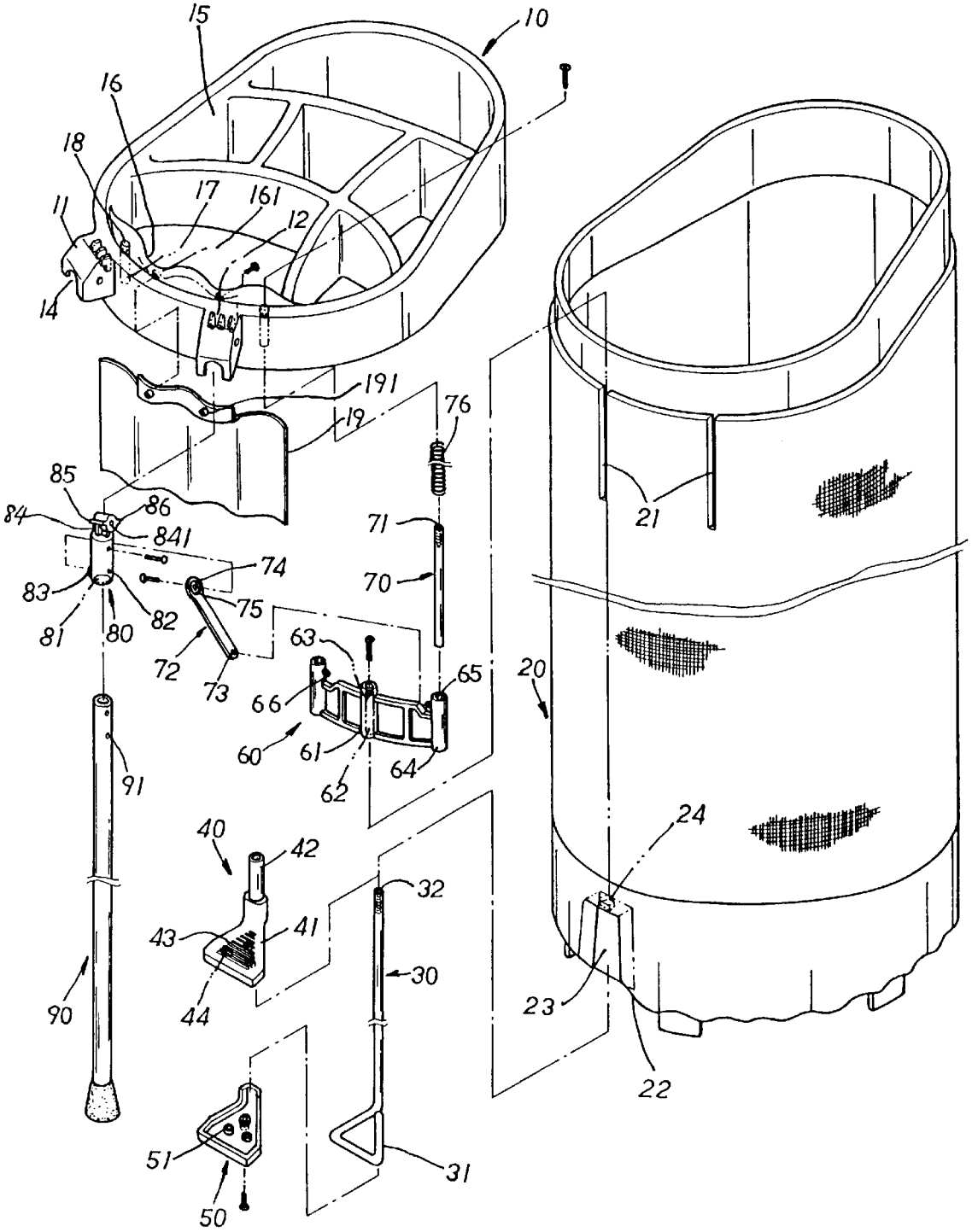
FIG. 1 is a perspective diagram showing the exploded components of the present invention.

Referring to FIG. 1, the supporting frame of the present invention comprises a head bracket 10, a receiving bag 20, a supporting board 19, a linking rod 30, a linking rod top cover 40 and a linking rod lower base 50, a transmission block 60, a pair of guiding shafts 70, a pair of springs 76, a pair of connecting rods 72, a pair of coupling sleeves 80 and a pair of supporting legs 90.

The head bracket 10 made in conformance to the shape of the opening of the receiving bag 20 is engaged with the top of the same. At the back of the periphery of the head bracket 10 is equipped with a pair of symmetrically disposed hollow housing projectors 11 which has a plurality of spaced retaining units 12 at the top edge thereof. At both sides of the each housing projector 11 is disposed a pivot hole and the external side thereof is disposed a dodge recess 14. In the closure of the head bracket 10 are disposed a plurality of partitioned spaces 15 for housing golf clubs of different types. At the rear internal surface of the head bracket 10 is defined a corrugated receiving room 16 for housing the corrugated supporting board 19 having an extended coupling piece with a pair of tubular screw holes 191 at the top edge thereof. At the top edge of the receiving room 16 are disposed a pair of locking holes 161 for securing the supporting board 19 in place by screws.

Figure 2:
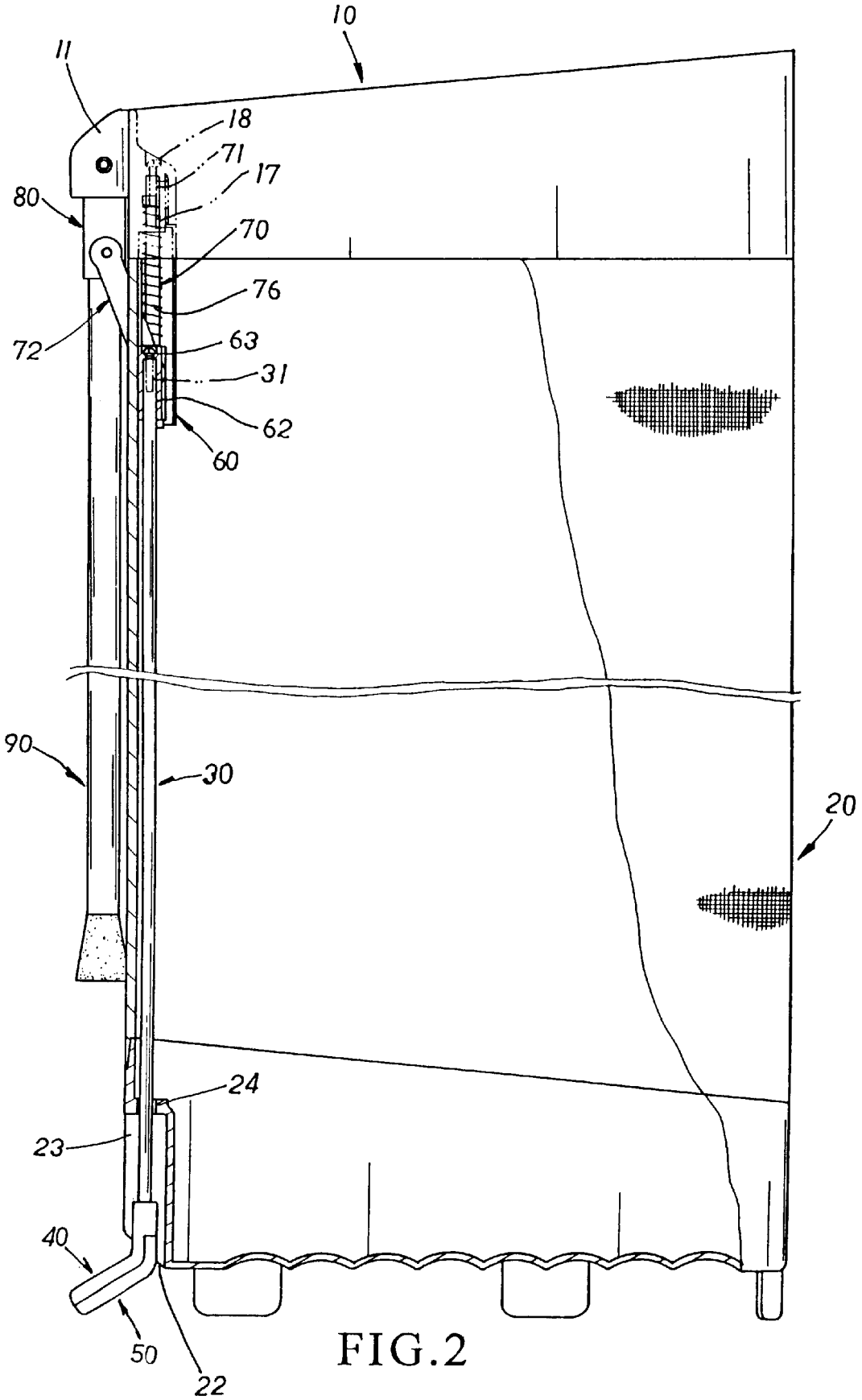
FIG. 2 is a sectional diagram showing the assembly thereof.
Figure 3:
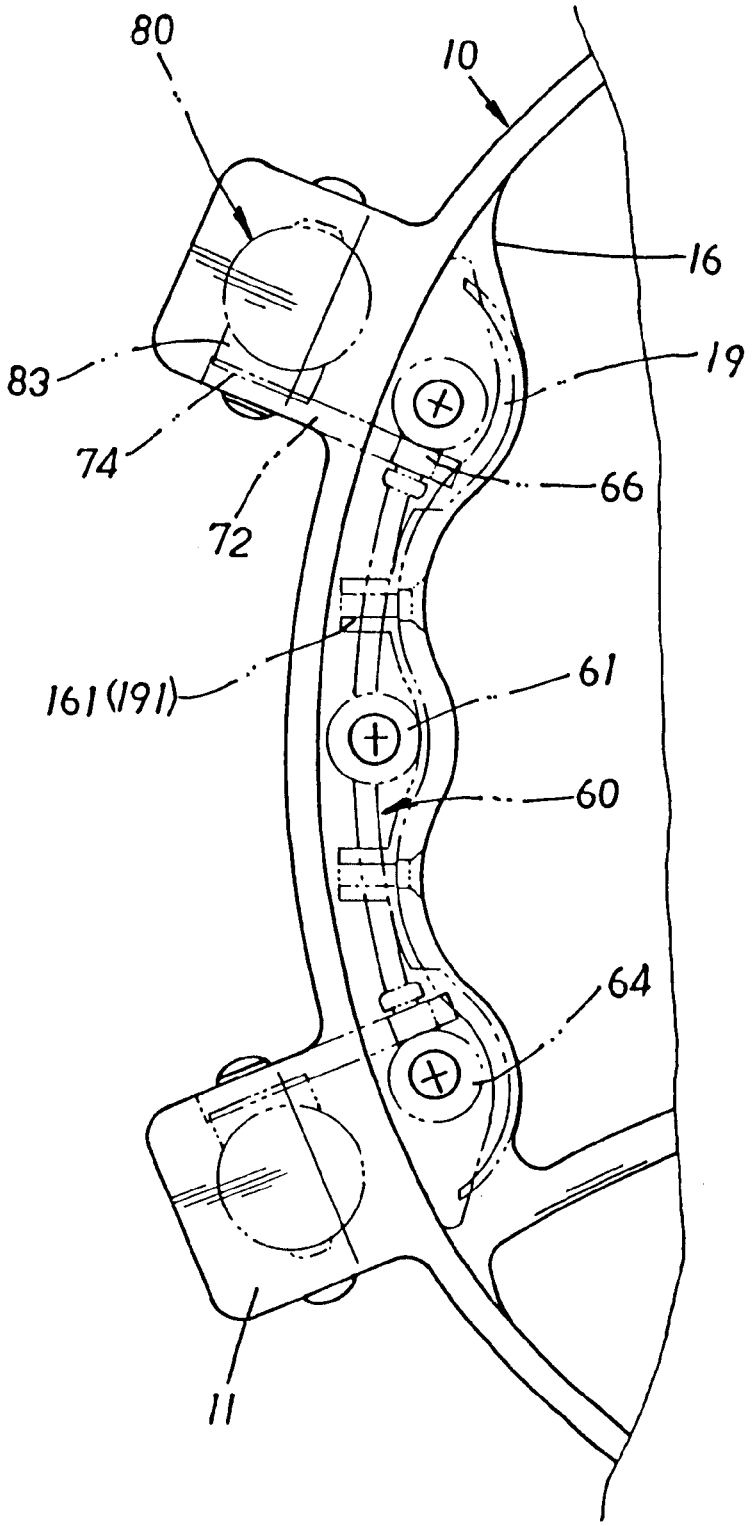
FIG. 3 is a view thereof.
Figure 4:
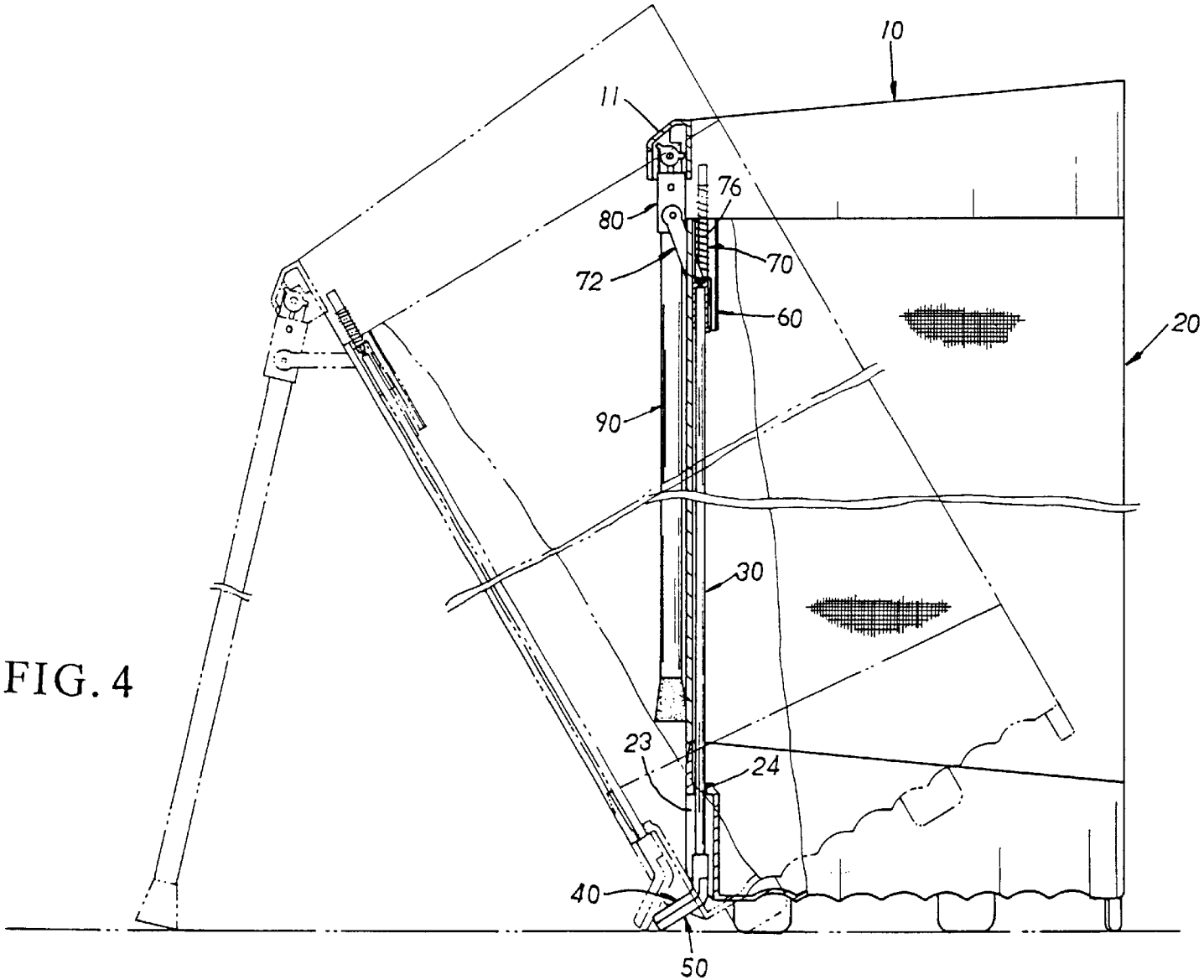
FIG. 4 is diagram showing two operation modes thereof.

There is a shaft housing tube 17 disposed at each end of the corrugated wall of the receiving room 16, as shown in FIG. 2. At the top of each housing tube 17 is disposed a countersunk hole 18.

On the rear side of the receiving bag 20 are disposed a pair of vertical splits 21 adjacent to the top and a slant flat section 22 at the bottom thereof. A dodge cavity 23 defined in the vicinity of the slant flat section 22 has a central through hole 24 at the top thereof.

The linking rod 30 of a length conforming to the height of the receiving bag 20 has a triangular supporting base 31 outwardly bent and an axially extended locking hole 32 at the top end. The top cover 40 made in conformance to the shape of the triangular supporting base 31 of the linking rod 30 has a cover block 41 terminating in a vertical connecting tube 42 with a plurality of fine ditches 43 disposed on the surface thereof and a plurality of locking studs 44 disposed thereunder. The diameter of the connecting tube 42 is slightly larger than that of the linking rod 30.

The lower base 50 matches with the shape of the top cover 40 and has a plurality of screw locking holes 51 corresponding to those locking studs 44 of the top cover 40 so that the top cover 40 and the lower base 50 can be integrally locked together with the triangular base 31 sandwiched therebetween.

The transmission block 60 is made up of a central engaging column 61 for the linking rod 30 and a pair of symmetric side inserting columns 64 for locating the guiding shafts 70. The central engaging column 61 has an insertion tube 62 at the bottom end, as shown in FIG. 2, and a countersunk hole 63 at the top end thereof. The inserting columns 64 have respectively an axially extended cross-shaped hole 65 slightly larger than each guiding shaft 70 in diameter. At the top of each side inserting column 64 is disposed a horizontally projected pivot pin 66.

Each guiding shaft 70 of a proper length has an axially extended locking hole 71 of a proper depth at the top end thereof.

Each connecting rod 72 has a pivot hole 73 at one end and a coupling hole 74 with a countersunk cavity 75.

Each spring 76 of a proper length is attached to the top of the guiding shaft 70.

Each coupling sleeve 80 is equipped with a tubular section 81 on which are disposed a couple of laterally extended retaining holes 82. Adjacent the bottom end of the sleeve 80 is disposed a projected tube section 83 and to the top end thereof is secured a retaining head 84 which has a lateral pivot hole 841, a relief positioning rib 85 and a collection positioning rib 86.

The supporting leg 90 of a proper length has an outer diameter in match with the inner diameter of the coupling sleeve 80 and has a couple of locking holes 91 defined in alignment with the retaining holes 82.

In assembly, the top cover 40 is first secured to the triangular supporting base 31 of the linking rod 30 which is led through the vertical connecting tube 42, integrally together with the lower base 50. Then the guiding shafts 70 are respectively led through the bottom of the shaft housing tubes 17 disposed at each end of the corrugated inner wall of the receiving room 16 of the head bracket 10 and are locked in place by screws led through the countersunk hole 18 of the shaft housing tube 17 and the locking hole 71 of the guiding shaft 70. Then the linking rod 30 led through the central through hole 24 of the dodge cavity 23 and further into the insertion tube 62 from the bottom end thereof is integrally secured to the transmission block 60 by a screw placed in the countersunk hole 63 of the central engaging column 61 and the locking hole 32 of the linking rod 30 so as to secure the linking rod 30 to the transmission block 60.

Next, the spring 76 and the hole 65 of each side inserting column 64 are led into registration with the bottom end of each guiding shaft 70. Each connecting rod 72 is in pivotal engagement with the pivot pin 66 of the transmission block 60. The supporting board 19 having an extended coupling piece with a pair of tubular screw holes 191 disposed at the top edge thereof is integrally secured to the top edge of the receiving room 16 by screws registered with the tubular screw holes 191 and the locking holes 161. Afterwards, the head bracket 10 is attached to the top of the receiving bag 20; and during the attachment, the two guiding shafts 70, the transmission block 60, the two connecting rods 72 and the linking rod 30 are all placed in the interior of the receiving bag 20. At the same time, the two connecting rods 72 partially stick out of the vertical splits 21 of the receiving bag 20, then the two coupling sleeves 80 are in pivotal engagement with the housing projectors 11 of the head bracket 10 at their retaining heads 84. As the coupling sleeves 80 are coupled to the head bracket 10, the countersunk cavity 75 of each connecting rod 72 can be in fit registration with the projected tube section 83 of each coupling sleeve 80 and the connecting rod 72 is fixed to the tube section 83 by rivets so as to pivotally connect the coupling sleeves 80 to the connecting rods 72 sticking out of the vertical splits 21 respectively. At a last stage, each supporting leg 90 is inserted into and engaged with the tubular section 81 of the coupling sleeve 80 by rivets led through the locking holes 91 positioned in alignment with the retaining holes 82.

When the tilted golf bag 20 is simply pushed to stand in a vertical position, the compressed spring 76 will be relieved to fully extend, resulting in the transmission block 60 being forced downwardly along with the linking rod 30 pulled downwardly by the top cover 40 in contact with the ground. Therefore, the connecting rods 72, the coupling sleeves 80 and the supporting legs 90 are forced to lean against the golf bag 20. At the same time, the collection positioning rib 86 of each retaining head 84 is in limiting engagement with the underside of the retaining units 12. Thus the supporting legs 90 are limited from excessive operation which can cause the damage of the housing projectors 11. The hole 65 of each side inserting column 64 can confine the guiding shafts 70 of their linear movement so as to prevent the transmission block 60 from being out of position in sliding.

As the golf bag 20 is placed in a tilted position, the lower base 50 of the linking rod 30 is in contact with the ground, the linking rod 30 will be pushed upwardly a small distance, the spring 76 is accordingly compressed, resulting in the transmission block 60 being pushed upwardly to get the connecting rods 72 pivoted upwardly. As a result the coupling sleeves 80 and the supporting legs 90 are outwardly extended to lean against the ground and the relief positioning rib 85 of the retaining head 84 moves to the upper side of the spaced retaining units 12 of the head bracket 10. Thus, the supporting legs 90 are limited to extend in a proper angle so as to prevent the damage of the housing projectors 11.

I claim:

1. A supporting frame for a golf bag, comprising:

a head bracket attached to a top of a receiving bag of said golf bag, a supporting board, a linking rod, a linking rod top cover and a linking rod lower base, a transmission block, a pair of guiding shafts, a pair of springs, a pair of connecting rods, a pair of coupling sleeves and a pair of supporting legs; wherein:

said head bracket is secured to a top opening of said receiving bag; at a back of the periphery of said head bracket is equipped with a pair of symmetrically disposed hollow housing projectors each of which has a plurality of spaced retaining units at a top edge thereof;

in said head bracket are disposed a plurality of partitioned spaces for housing golf clubs; at a rear internal surface of said head bracket is defined a corrugated receiving room for housing said corrugated supporting board having an extended coupling piece with a pair of tubular screw holes at the top edge thereof, at a top edge of said receiving room are disposed a pair of locking holes for securing said supporting board in place by screws; a shaft housing tube is disposed at each end of said corrugated wall of said receiving room;

on a rear side of said receiving bag are disposed a pair of vertical splits adjacent to a top so as to permit said connecting rods to be partially exposed; and a slant flat section at the bottom thereof, a dodge cavity defined in the vicinity of said slant flat section has a central through hole at the top thereof;

said linking rod has a triangular supporting base outwardly bent at a bottom end and an axially extended locking hole at a top end thereof; said top cover attached to said triangular supporting base of said linking rod has a cover block terminating in a vertical connecting tube with a plurality of locking studs disposed thereunder;

said lower base is integrally secured to said top cover with said triangular base sandwiched therebetween;

said transmission block has a central engaging column for engaging with said linking rod and a pair of symmetric side inserting columns for locating said guiding shafts; at the top of each said side inserting column is disposed a horizontally projected pivot pin; each said connecting rod is in pivot engagement with said transmission block by said projected pivot pin at one end and is in pivotal connection to each coupling sleeve at another end;

each said spring is attached to the top of each said guiding shaft respectively; each coupling sleeve is secured to a top end of each supporting leg and is in pivotal engagement with said head bracket; and to the top end thereof is secured a retaining head which has a lateral pivot hole, a relief positioning rib and a collection positioning rib; each said supporting leg has a top end engaged with said coupling sleeve so as to permit said supporting leg to be pivotally extended with respect to said receiving bag; whereby said coupling sleeves and said supporting legs are securely engaged with each other; and said coupling sleeves are further in pivotal engagement with said housing projectors of said head bracket attached to the top of said receiving bag; said guiding shafts are fixed in place to said head bracket; and said coupling sleeves are further in pivotal connection to said transmission block by said connecting rods; and said linking rod is fixed to said transmission block which is limited to slide up and down along said guiding shafts by said springs confined between said transmission block and said guiding shafts as said triangular base covered by said top cover and said lower base of said linking rod is in contact with a ground so as to permit said transmission block to slide up and down by way of said springs, resulting in the extension or collection of said supporting legs and said connecting rods automatically away or toward said receiving bag accordingly when said receiving bag is tilted one side or placed in a vertical position.

2. A supporting frame for a golf bag, comprising:

a head bracket attached to the top of a receiving bag of said golf bag, a supporting board, a linking rod, a linking rod top cover and a linking rod lower base, a transmission block, a pair of guiding shafts, a pair of springs, a pair of connecting rods, a pair of coupling sleeves and a pair of supporting legs; wherein:

said head bracket made in conformance to a shape of a top opening of said receiving bag is engaged with the top thereof; at a back of the periphery of said bead bracket are disposed a pair of symmetrically disposed hollow housing projectors each of which has a plurality of spaced retaining units at a top edge thereof, at both sides of each said housing projector is disposed a pivot hole and the external side thereof is disposed a dodge recess; in a closure of said head bracket are disposed a plurality of partitioned spaces for housing golf clubs; at a rear internal surface of said head bracket is defined a corrugated receiving room for housing said corrugated supporting board having an extended coupling piece with a pair of tubular screw holes at the top edge thereof, at a top edge of said receiving room are disposed a pair of locking holes for securing said supporting board in place by screws;

a shaft housing tube is disposed at each end of said corrugated wall of said receiving room; at a top of each said housing tube is disposed a countersunk hole; on a rear side of said receiving bag are disposed a pair of vertical splits adjacent to a top and a slant flat section at the bottom thereof, a dodge cavity defined in the vicinity of said slant flat section has a central through hole at the top thereof, said linking rod of a length conforming to the height of said receiving bag has a triangular supporting base outwardly bent and an axially extended locking hole at a top end thereof, said top cover made in conformance to a shape of said triangular supporting base of said linking rod has a cover block terminating in a vertical connecting tube with a plurality of fine ditches disposed on the surface thereof and a plurality of locking studs disposed thereunder and a diameter of said connecting tube is slightly larger than that of said linking rod;

said lower base matches with a shape of said top cover and has a plurality of screw locking holes corresponding to said locking studs of said top cover so that said top cover and said lower base can be integrally locked together with said triangular base sandwiched therebetween;

said transmission block is made up of a central engaging column for said linking rod and a pair of symmetric side inserting columns for locating said guiding shafts; said central engaging column has an insertion tube at the bottom end and a countersunk hole at the top end thereof, said inserting columns have respectively an axially extended cross-shaped hole slightly larger than each said guiding shaft in diameter; at the top of each said side inserting column is disposed a horizontally projected pivot pin;

each said guiding shaft of a proper length has an axially extended locking hole of a proper depth at a top end thereof;

each said connecting rod has a pivot hole at one end and a coupling hole with a countersunk cavity;

each said spring of a proper length is attached to the top of each said guiding shaft respectively;

each coupling sleeve is equipped with a tubular section on which are disposed a couple of laterally extended retaining holes; adjacent a bottom end of said sleeve is disposed a projected tube section and to the top end thereof is secured a retaining head which has a lateral pivot hole, a relief positioning rib and a collection positioning rib; said supporting leg of a proper length has an outer diameter in match with the inner diameter of said coupling sleeve and has a couple of locking holes defined in alignment with the retaining holes;

whereby said coupling sleeves and said supporting legs are securely engaged with each other; and said coupling sleeves are further in pivotal engagement with said housing projectors of said head bracket which is secured to the top edge of said receiving bag; said guiding shafts are fixed in place to said head bracket; and said coupling sleeves are further in pivotal connection to said transmission block by said connecting rods; and said linking rod is fixed to said transmission block which is limited to slide up and down along said guiding shafts by said springs confined between said transmission block and said guiding shafts as said triangular base covered by said top cover and said lower base of said linking rod is in contact with a ground so as to permit said transmission block to slide up and down by way of said springs, resulting in the extension or collection of said supporting legs and said connecting rods automatically away or toward said receiving bag accordingly when said receiving bag is tilted one side or placed in a vertical position.

* * * * *